US005779604A

United States Patent [19]

Towley, III et al.

[11] Patent Number: 5,779,604

[45] Date of Patent: *Jul. 14, 1998

[54] ADJUSTABLE DUMBBELL

[75] Inventors: Carl K. Towley, III; Gregory S. Olson, both of Owatonna, Minn.

[73] Assignee: Intellbell Ventures, Monterey, Calif.

[ * ] Notice: The term of this patent shall not extend beyond the expiration date of Pat. No. 5,637,064.

[21] Appl. No.: 610,512

[22] Filed: Mar. 4, 1996

Related U.S. Application Data

[63] Continuation-in-part of Ser. No. 186,937, Feb. 2, 1994, abandoned, which is a continuation-in-part of Ser. No. 13,785, Feb. 5, 1993, abandoned.

[51] Int. Cl.[6] ..... A63B 21/075

[52] U.S. Cl. ..... 482/108; 482/107

[58] Field of Search ..... 482/92–94, 97–100, 482/908; D21/196, 197

[56] References Cited

U.S. PATENT DOCUMENTS

| | | | |
|---|---|---|---|
| D. 244,628 | 6/1977 | Wright | D21/197 |
| D. 307,168 | 4/1990 | Vodhanel | D21/197 |
| D. 315,003 | 2/1991 | Huang | D21/197 |
| D. 321,230 | 10/1991 | Leonesio | D21/197 |
| D. 359,778 | 6/1995 | Towley, III | D21/197 |
| 1,672,944 | 6/1928 | Jowett | 482/108 |
| 1,917,566 | 7/1933 | Wood . | |
| 4,076,236 | 2/1978 | Ionel | 482/108 |
| 4,651,988 | 3/1987 | Sobel | 482/93 X |
| 5,131,898 | 7/1992 | Panagos | 482/108 |

FOREIGN PATENT DOCUMENTS

| | | | |
|---|---|---|---|
| 2452296 | 10/1980 | France . | |
| 384485 | 11/1964 | Switzerland . | |
| 1367987 | 1/1988 | U.S.S.R. | 482/108 |
| 1659073 | 6/1991 | U.S.S.R. | 482/108 |

*Primary Examiner*—Richard J. Apley
*Assistant Examiner*—John Mulcahy
*Attorney, Agent, or Firm*—James W. Miller

[57] ABSTRACT

An adjustable dumbbell (10) includes a central handle (22) which can be selectively connected to one or more outer weights (24) by means of a selector pin (26). The outer weights (24) are arranged in a nested symmetrical stack which provides for a compact construction and storage of the unused weights at the same time. The adjustable dumbbell (10) is also incrementally adjustable, and may be used either in conjunction with or as a substitute for a conventional weight stack in an exercise machine. Two additional embodiments (120 and 130) are disclosed.

23 Claims, 5 Drawing Sheets

ADJUSTABLE DUMBBELL

CROSS REFERENCE TO RELATED APPLICATION

This application is a continuation-in-part of application Ser. No. 08/186,937, filed Feb. 2, 1994 and now abandoned, which is a continuation-in-part of application Ser. No. 013,785 filedFeb. 5, 1993 and now abandoned.

TECHNICAL FIELD

The present invention relates generally to exercise equipment. More particularly, this invention pertains to an adjustable barbell or dumbbell of improved, compact construction.

BACKGROUND ART

Modern dumbbells have a long and interesting history. The earliest record of a dumbbell was the stone "haltere" used by the ancient Greeks and Romans to train their long jumpers. They were carried and dropped at lift off, and it was thought that the sudden release of the haltere resulted in the athlete jumping a greater distance.

During the 1700's and 1800's the wooden Indian club (pin) was popular as a gentlemen's physical culture device. These clubs were available in different weights and like the modern fixed weight dumbbell, were complete with a rack for storage. The heaviest Indian club was approximately thirty-five pounds. Considering that the athlete always grasped the club at its end, the use of a thirty-five pound pin was quite a demonstration of fore-arm strength.

The advent of the modern strongman in the late 1800's saw the development of the kettle bell. Like the Indian club, this bell forced the athlete to grasp an unbalanced weight resembling a bowling ball with a handle. Considerable skill, balance and strength was required to lift a kettle bell, the heaviest of which was in the 200–300 pound range.

Early balanced iron dumbbells became available after the turn of the century, with adjustable dumbbells being introduced by Milo Stanborn just before World War II.

Today, dumbbells are generally recognized as the most efficient of strength training devices. They allow extreme flexibility in patterns of movement and allow the athlete to perform a real world training regimen unlike, for example, bungee cord exercises. Therapists like to utilize dumbbells because they reflect of everyday movements and their flexibility allows the patient to train around joint and muscle trauma. Athletes that train with dumbbells enjoy productive gains not available with other training modalities because they require balance and involve synergistic muscle groups to contract during the lift. The necessity to balance the dumbbells and coordinate movement of each hand stress the muscular and nervous system unlike any machine exercise. With machines, a portion of the athlete's musculature can actually relax due to the absence of fully balanced coordination; ie, one side can push harder than the other.

There are two basic forms of dumbbells: fixed or "pro-style", and adjustable dumbbells. Fixed dumbbells are individually compact, but are typically sold in sets which must be stored on a rack that is bulky and cumbersome. Adjustable dumbbells have historically incorporated plates and locking collars secured to the ends of an extended handle.

Adjustable dumbbells are the most space and cost efficient exercise equipment, however, they are not without some drawbacks. One drawback is the time it takes to change or adjust both dumbbells. Removing and replacing the locking collars and plates is time consuming, and can be a potential safety hazard if the collars are not securely tightened. Another drawback is that it is difficult to perform a "kickup" due to the protruding end of the handle. Some exercises such as bench presses, inclines and shoulder work typically begin and end with the dumbbells resting on the knees of the athlete, however, this can be unwieldy and painful if the ends of the dumbbells are not relatively flat.

Various adjustable dumbbells have been developed heretofore. U.S. Pat. Nos. 4,948,123 and 4,566,690 to Schook, 4,913,422 to Elmore et al, 4,900,016 to Caruthers, 4,880,229 to Broussard, 4,743,017 to Jaeger, and 4,529,198 to Hettick are representative of the prior art in this regard. Each of these references, however, addresses only certain aspects of an adjustable dumbbell, such as releasability, interlocking of the weights, etc.

There is still a need for an adjustable dumbbell of improved construction which is not only compact in size, but also easily and securely adjustable and comfortable to use without the clutter of loose weights.

SUMMARY OF INVENTION

The present invention comprises an improved dumbbell which overcomes the foregoing and other difficulties associated with the prior art. In accordance with the invention, there is provided a unique adjustable dumbbell which incorporates a nested weight arrangement. The adjustable dumbbell herein generally comprises a handle portion, a weight portion including a plurality of weights and means for selectively connecting the handle portion to the desired number of weights therein. The other weights remain together in a stacked or nested arrangement. By means of this unique configuration the length of the dumbbell increases with weight. The adjustable dumbbell herein can also be adjusted for incremental weights, and may also be adjusted to provide offset leverage at the grip in the handle portion for even more effective training. Several embodiments and modifications are disclosed.

BRIEF DESCRIPTION OF DRAWING

A better understanding of the invention can be had by reference to the following Detailed Description in conjunction with the accompanying Drawing, wherein.

DETAILED DESCRIPTION

Figure 1:
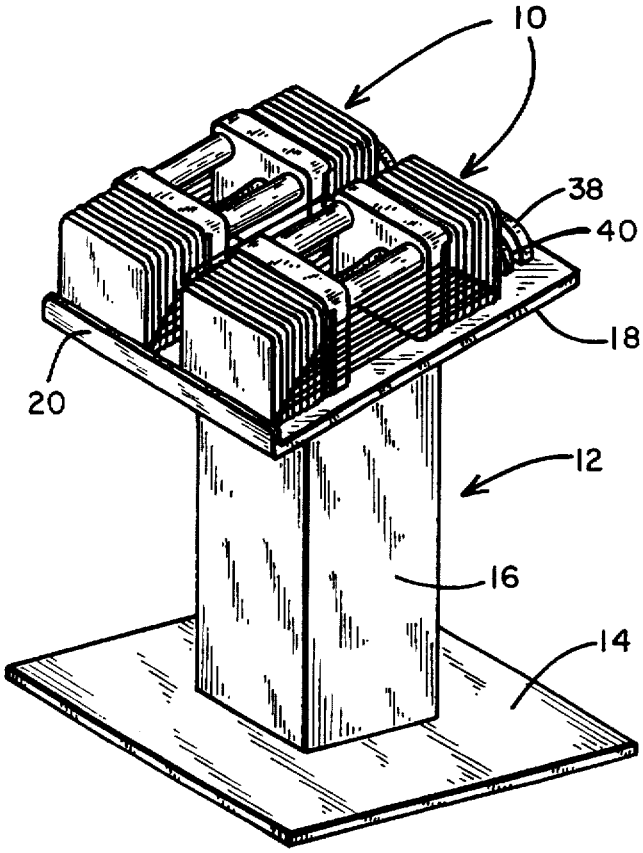
FIG. 1 is a perspective view of the adjustable dumbbell incorporating a first embodiment of the invention, shown on a stand.

Referring now to the Drawing, wherein like reference numerals designate like or corresponding elements throughout the views, and particularly referring to FIG. 1, there is shown a pair of adjustable dumbbells 10 incorporating the invention. The dumbbells 10 are shown on a stand 12 including a base 14, column 16 and inclined top tray 18. The upper surface of tray 18 is preferably coated or lined with an elastomeric material for skid resistance and noise reduction. A lip 20 is provided at the lower edge of tray 18 to prevent the adjustable dumbbells 10 from slipping off the stand 12. The stand 12 is preferably formed of sheet metal, with the top tray 18 tilted and elevated for convenient access by an athlete. As will be explained more fully hereinafter, the adjustable dumbbells 10 incorporate a unique nested handle and weight arrangement for more compact construction.

Figure 3:
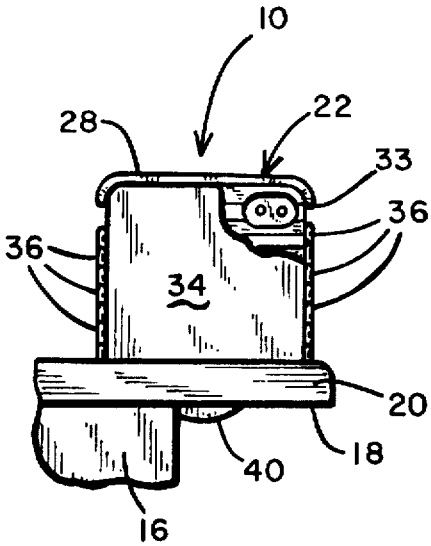
FIG. 3 is an end view thereof.
Figure 2:
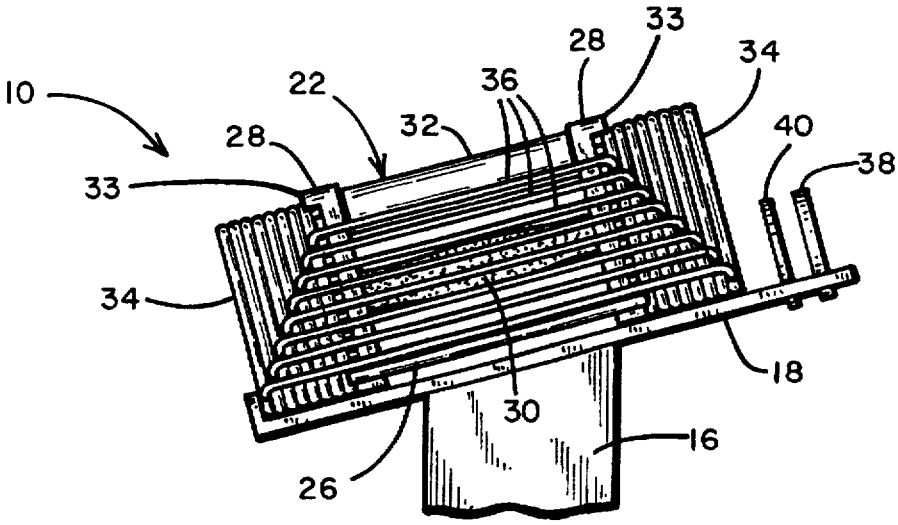
FIG. 2 is a side view of the adjustable dumbbell herein.
Figure 4:
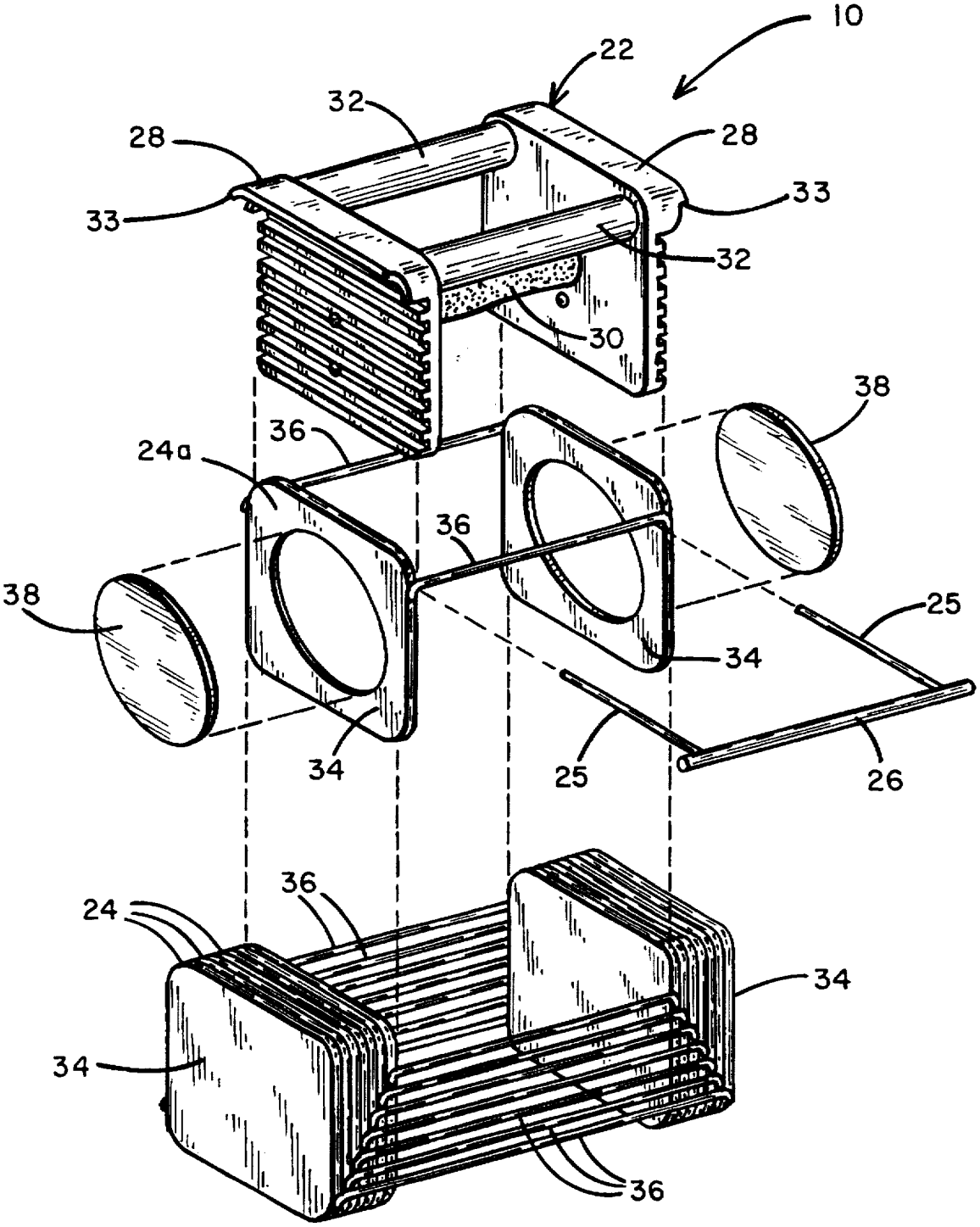
FIG. 4 is an exploded perspective view thereof.

Referring to FIGS. 2–4, the adjustable dumbbell 10 includes a central handle 22 selectively connected to one or more of a plurality of nested outer weights 24 by means of a selector pin 26. The handle 22 includes a pair of longitudinally spaced apart ends 28 interconnected by a generally centrally located grip 30 and a pair of laterally spaced apart crosstubes 32. The handle 30 is preferably coated or surrounded by a sleeve of foam material for comfort. Since the crosstubes 32 contact the wrists of the athlete during use of the dumbbell 10, they are also preferably coated or encased with a similar foam material for comfort.

If desired, the grip 30 and crosstubes 32 can be mounted for adjustability. The grip 30 is shown in a position substantially coincident with the center of gravity of the dumbbell 10, however, if desired, an alternate offset mounting position can be provided as best seen in FIG. 4 in order to create some leverage so as to effectively increase the training resistance. Similarly, alternate mounting positions for the crosstubes 32 can be provided as shown for adjusting the spacing therebetween in accordance with the wrist size of the athlete, as best seen in FIG. 3.

The handle 22 fits inside a nested arrangement of weights 24. In the preferred embodiment, eight such weights 24 are provided, each weighing about ten pounds for a total of eighty pounds. Any desired combination of weights can be used. For example, five weights 24 each weighing about five pounds for a total of twenty five pounds, could be used. Outward lips or projections 33 are provided on the ends 28 of handle 22 for contacting the first innermost weight 24, which is in contact with each successive weight.

In particular, each weight 24 includes two longitudinally spaced apart end plates 34 interconnected by a pair of side rails 36. Each side rail 36 includes a generally straight middle portion with downwardly turned ends, which are preferably welded to the rounded peripheral edge of the respective plate 34. The side rails are also preferably spaced slightly outward from the edges of plates 34 to facilitate nesting. The end plates 34 are preferably generally square or rectangular with rounded edges and are of about the same size, weighing about five pounds each. The side rails 36 interconneccting the end plates 34 of the same weight 24 are of the same length, but are of different relative lengths and positioned in vertically offset relationship between adjacent weights so as to form a nested stack as shown with sufficient space between adjacent side rails to receive the selector pin 26. The side rails 36 for the innermost weight 24 are shortest and closest to the top of handle 22, while the side rails of each successive weight are progressively longer and farther downward. The ends of each side rail 36 normally rest on the side rail of the next weight 24 below it so that handle 22 is in direct contact with and through each weight 24.

The outer ends 28 of handle 22 are preferably grooved as shown for receiving the sides or prongs 25 of the selector pin 26. This helps to distribute shear stress for more safety. Accordingly, insertion of the selector pin 26 beneath the side bars 36 connects that weight 24 and any weights above it to the handle 22 for movement therewith. In other words, the selector pin 26 serves to connect a given weight 24 and any other innermost weight(s) inwardly thereof to the handle 22 in accordance with the training resistance desired. The rest of the outermost weights 24 remain together in a stacked/nested configuration on the floor or stand 12 when not in use. This comprises a significant feature of the present invention.

Referring particularly to FIG. 4, the end plates 34 of the innermost weight 24A may include recesses or apertures as shown for receiving supplemental weights 38 which would be captured in position by the handle 22. This would provide some intermediate adjustment between the ten pound increments of weights 24. For example, the supplemental weights 38 could each be about two and one-half pounds. If desired, another set of supplemental weights 40 of a different size, such as about one and one-quarter pounds each in order to provide a total of two and one-half pounds adjustment, as shown in FIGS. 1 and 2, could be provided for additional flexibility.

Both the end plates 34 of weights 24 and the ends 28 of handle 22 are preferably angled slightly outwardly, such at about three degrees, for safety purposes to prevent disconnection from the handle 22 if pin 26 should come out while the dumbbell is inverted or overhead. This also promotes ease of use when racking or renesting and eliminates the need for secondary tracking methods, thus reducing cost and complexity.

Figure 5:
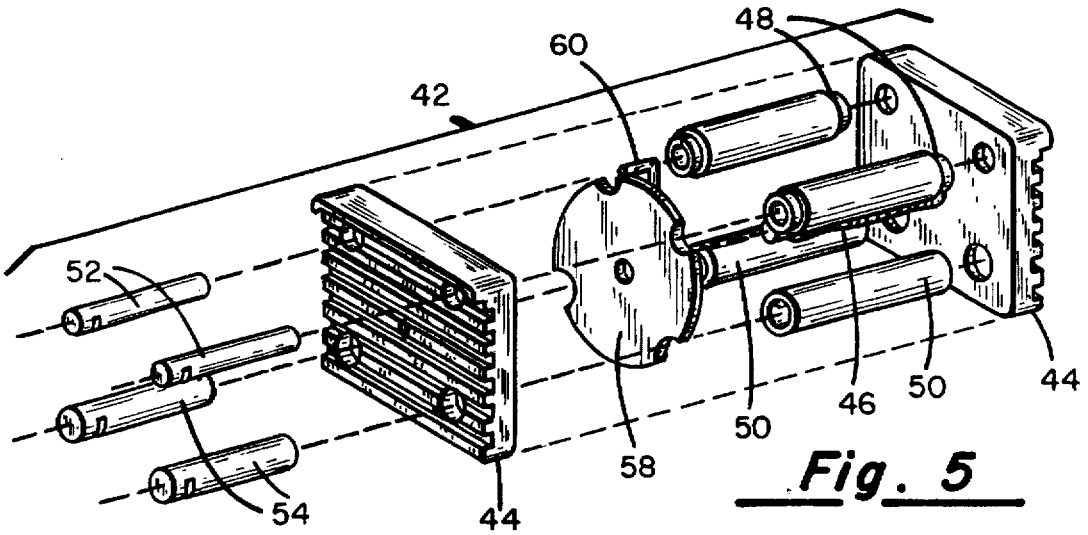
FIG. 5 is an exploded perspective view of an alternate handle construction.
Figure 6:
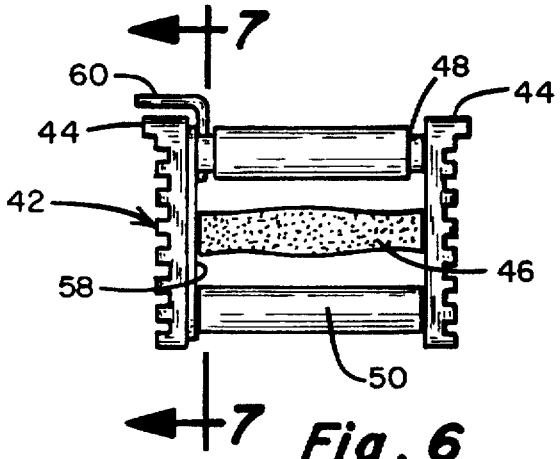
FIG. 6 is a side view thereof.
Figure 7:
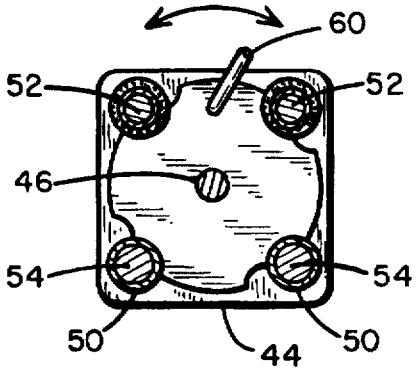
FIG. 7 is a sectional view taken along lines 7—7 of FIG. 6 in the direction of the arrows.

FIGS. 5–7 show an alternate handle 42 which provides even more flexibility in adjustment. The handle 42 includes a pair of longitudinally spaced apart ends 44 which are grooved across their outer surfaces similar to the ends 28 of handle 22. A central grip 46 similar to grip 30 is likewise secured between the ends 44. However, the handle 42 incorporates four hollow crosstubes 48 and 50 extending between the corners of the ends 44, which crosstubes are closed at one end and open at the other through openings in that end 44 for receiving cylindrical ballast weights 52 and 54 therein. In accordance with the preferred embodiment, the crosstubes 48 and 50 are of different sizes for respectively receiving ballast weights 52 and 54 of different relative sizes. For example, each ballast weight 52 can weigh about 0.75 pound, while each ballast weight 54 can weigh about 1.25 pound. Further, each of the ballast weights 52 and 54 includes a circumferential recess or groove for receiving the periphery of a locking disc 58 which is rotatable about the grip 46 by means of lever 60 in order to secure the weights within the handle 42. As shown, the periphery of the locking disc 56 includes four cutouts which cooperate with adjacent circumferential slots in the crosstubes 48 and 50 so as to selectively secure the ballast weights 52 and 54 within the handle 42. The handle 42 can thus be used either alone or with one or more weights 24. Further, any combination of ballast weights 52 and 54, either alone or together with one or both of the others, can be used to achieve the desired degree of adjustment and leverage for most effective training.

Figure 8:
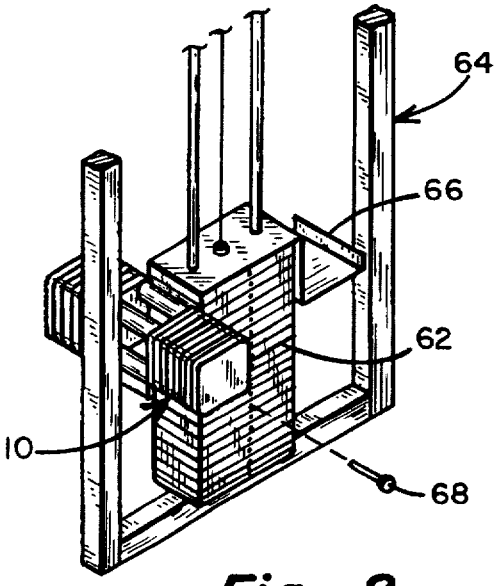
FIGS. 8 and 9 are illustrations showing the adjustable dumbbell herein utilized in conjunction with a conventional weight stack in an exercise machine.
Figure 9:
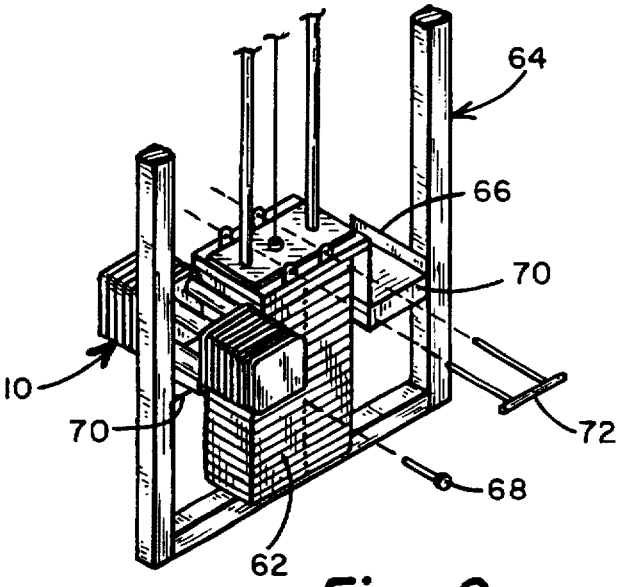

FIGS. 8 and 9 illustrate usage of the dumbbell 10 in conjunction with a conventional weight stack 62 in an exercise machine 64. In FIG. 8, the adjustable dumbbells 10, only one of which is shown, are set on a tray 66 extending over the top weight in the weight stack 62 in order to supplement whatever amount of weight is selected by means of pin 68. FIG. 9 shows a modified tray 66 which is normally supported on frame extensions 70 of the exercise machine 64, but which can be selectively connected to the top most weight in the weight stack 62 by means of pin 72 so that the exercise machine 64 can be used either with or without the supplemental weight of the adjustable dumbbells 10.

Figure 10:
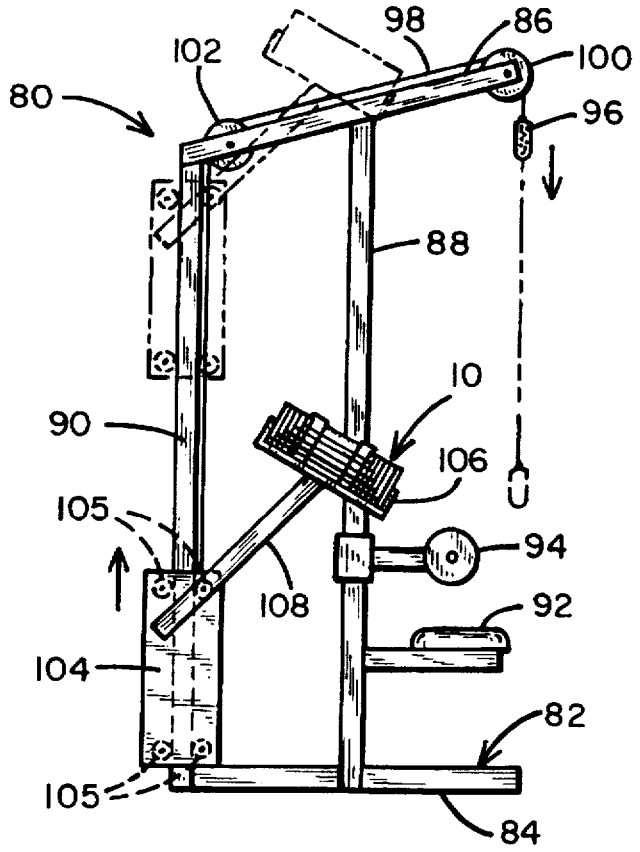
FIG. 10 is a side view of an exercise machine incorporating the adjustable dumbbell herein as the primary resistance.
Figure 11:
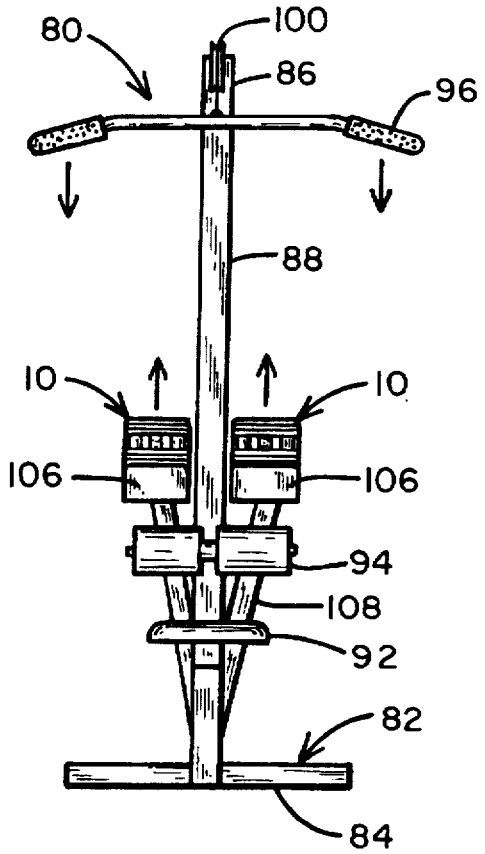
FIG. 11 is a front view thereof.

If desired, the adjustable dumbbell 10 herein could be adapted for use as a the primary resistance, instead of a supplement to a weight stack or other resistance, in an exercise machine. Referring to FIGS. 10 and 11, there is shown an exercise machine wherein a pair of dumbbells 10 are utilized as the primary resistance. As illustrated, the exercise machine 10 comprises a lat pull-down amchine, however, the adjustable dumbbells 10 herein could be incorporated into other types of exercise machines wherein adjustable weight training resistance is desired.

The exercise machine 80 includes a frame 82 comprising a base 84 and a boom 86 interconnected by a pair of columns 88 and 90. A seat 92 and a padded hip catch 94 are secured to the front column beneath a handle 96. The handle 96 is connected to the end of a cable 98 extending over pulleys 100 and 102 on the boom 86. The other end of the cable 98 is connected to a movable shuttle 104 which is constrained for movement along column 90 by rollers 105. Each dumbbell is supported on a tray 106 secured to an arm 108 on the common shuttle 104. The arms 108 are angled forward and upward as shown for convenient access to dumbbells 10 in trays 106 by an athlete from the front of machine 80, traveling along the sides of column 90 between a lowered position shown in solid lines and a raised position shown in phantom lines. This configuration also allows for a more compact construction requiring less floor space and less overhead clearance. The training resistance of the exercise machine 80 can thus be easily adjusted by means of dumbbells 10 which can also be removed and used separately.

If desired, the trays 106 could be positioned directly on the shuttle 104 without arms 108, although such arrangement would not be as accessible from the front of machine 80.

Figure 12:
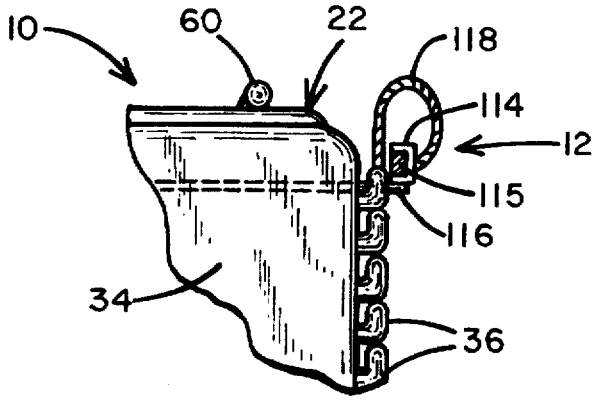
FIG. 12 is an enlarged partial end view of an alternate selector pin construction.

FIG. 12 illustrates an alternate selector pin 112. In particular, the selector pin includes a channel section 114, a pair of magnets 115 therein, and a generally U-shaped portion 116. The U-shaped portion 116 includes a pair of prongs that extend substantially entirely across the width of dumbbell 10 similarly to the prongs of pin 26. The use of magnets 115 helps to positively secure the selector pin 112 in place and against accidental disengagement. If desired, an elastic tether 118 can also be used for additional safety. The tether is preferably secured between the channel 114 of pin 112 and one side rail 36 of the innermost weight 24.

Figure 13:
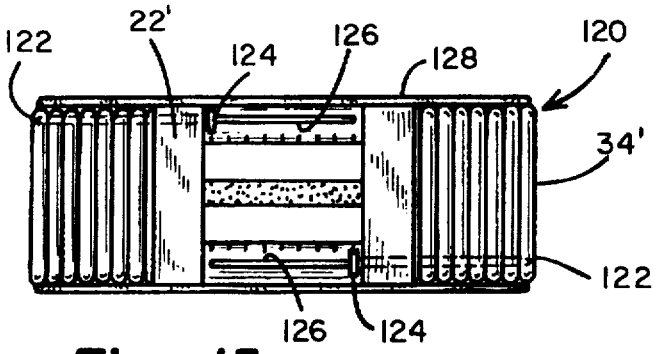
FIG. 13 is a top view of an adjustable dumbbell incorporating a second embodiment of the invention.
Figure 14:
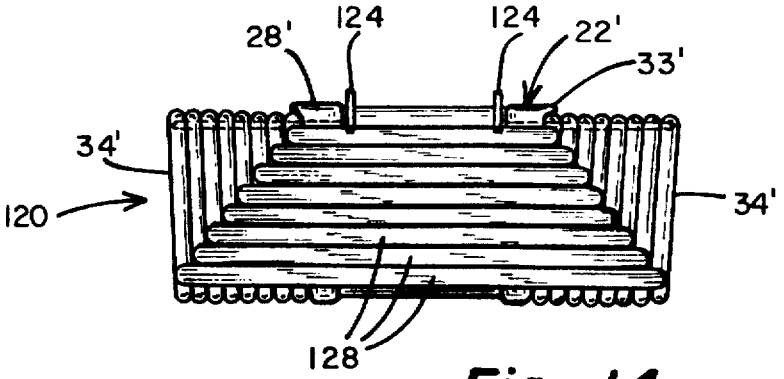
FIG. 14 is a side view thereof.

FIGS. 13 and 14 show an adjustable dumbbell 120 incorporating a second embodiment of the invention. The dumbbell 120 incorporates numerous component parts which are substantially similar to component parts of the dumbbell 10 herein. The same reference numerals have been used to identify such component parts, but with prime (') notations for differentiation.

The primary difference between the adjustable dumbbells 10 and 120 resides in the means by which the amount of weight is selected. In contrast to the dumbbell 10 which utilizes a side selector pin, the dumbbell 120 incorporates a pair of rigid pins 122 internal to the handle 22' which can be selectively advanced outwardly in opposite longitudinal directions into engagement with weights 24' in accordance with the weight desired. The pins 122 are slidably contained within crosstubes 32' for movement between a retracted position inside the handle 22' and positions projecting outwardly through aligned holes (not shown) in the ends 28' of the handle and the end plates 34' of weights 24'. Thumb tabs 124 are connected to the inner ends of the pins 122 through longitudinal slots 126 along the tops of crosstubes 32'. If desired, some form of detent arrangement could be utilized to secure pins 122 and thumb tabs 124 in positions corresponding to different predetermined weight selections.

In addition to the manner by which the desired weight is selected, the dumbbell 120 also incorporates different side rails 128 interconnecting the end plates 34' of weights 24'. Each side rail 128 is of generally flat, strap-like configuration in normal contacting stacked relationship as shown. Otherwise, the dumbbell 120 is substantially similar in construction and function to the dumbbell 10.

Figure 15:
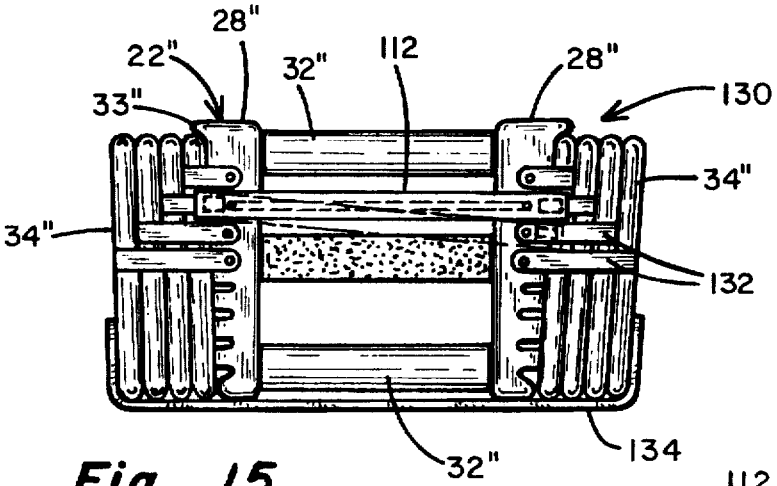
FIG. 15 is a side view of an adjustable dumbbell incorporating a third embodiment of the invention.

FIG. 15 shows a dumbbell 130 incorporating a third embodiment of the invention. The dumbbell 130 includes numerous component parts that are substantially similar to corresponding component parts of the dumbbell 10 herein. Such corresponding component parts have been identified with the same reference numerals, but with double prime (") notations for differentiation.

The primary difference between the dumbbells of the first and third embodiments herein resides in the fact that dumbbell 130 incorporates weights 24" whose opposing end plates 24" are not continuously connected. In particular, each plate 34" includes opposing pairs of longitudinal side tabs 132 with aperatures for receiving the prongs on pin 26 or 112. The end plates 34" of each weight 24" are thus normally nested but not connected. The end plates 34" of the weights 24" are only connected by the selector pin when and in accordance with the weight selection desired. The other innermost weights 24" are of course captured between the particular weight selected and handle 22" as before, while the other outer weights remain in a nested and stacked arrangement when not in use. Some sort of retainer, such as lower tray 134 is necessary with this embodiment in order to keep the remaining weights 24" from falling outward when not in use. The primary advantage of this embodiment is greater versatility in that the pin 112 can be connected not only between the tabs 132 of corresponding weights 24", but also the tabs on the end plates 34" of adjacent weights as shown in phantom lines, for adjustablity. The holes in tabs 132 are somewhat enlarged or loose to provide the necessary tolerance for such cross pinning. Otherwise, the dumbbell 130 is substantially similar in construction and function to the dumbbell of the first embodiment herein.

Figure 16:
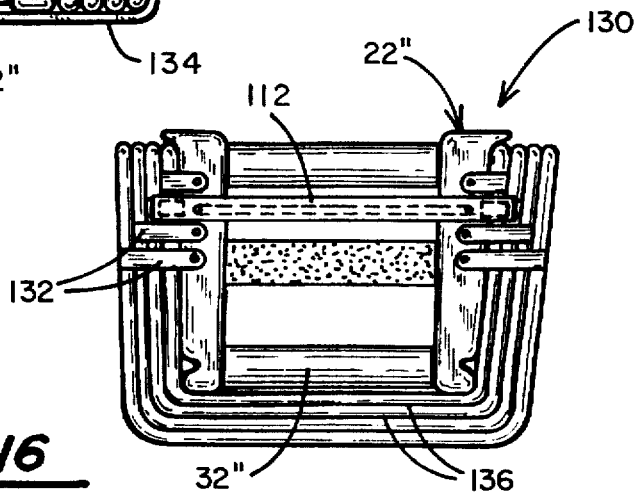
FIG. 16 is a side view of a modification thereof.

FIG. 16 illustrates a modification of the dumbbell 130 including end plates 34" that are connected at their bottoms 136. Such weights 24" can be constructed by conventional forming or stamping techniques in the manner of breadpans. Since the end plates 34" of each weight 24" are connected at the bottom, no additional retainer such as tray 134 would be required.

From the foregoing, it will thus be apparent that the present invention comprises an adjustable dumbbell having several advantages over the prior art. The dumbbell herein is of compact construction and is easily adjustable, growing in length with weight. The unused weights remain nested in an orderly stack in one place, rather than lying about loose. Other advantages will evident to those skilled in the art.

Although particular embodiments of the invention have been illustrated in the accompanying Drawing and described in the foregoing Detailed Description, it will be understood that the invention is not limited only to the embodiments disclosed, but is intended to embrace any alternatives, equivalents, modifications and/or rearrangements of elements falling within the scope of the invention as defined by the following claims.

What is claimed is:

1. An adjustable dumbbell, comprising:

a handle, said handle including a grip secured between a pair of longitudinally spaced apart ends;

at least one weight, said weight(s) including a pair of end plates and means for interconnecting the end plates together in longitudinally spaced apart relationship for receiving said handle with said grip located between upper and lower edges of said end plates and each said end plate being located longitudinally outwardly of one end of said handle; and means for selectively interconnecting said handle and said weight.

2. The adjustable dumbbell of claim 1, wherein the grip is generally centrally located between the ends of said handle.

3. The adjustable dumbbell according to claim 2, further including:

a pair of laterally spaced apart crosstubes secured between the ends in spaced apart relationship with the grip of said handle.

4. The adjustable dumbbell of claim 1, further including:

a sleeve of foam material surrounding the grip of said handle.

5. The adjustable dumbbell according to claim 1, further including:

a pair of laterally spaced apart crosstubes secured between the ends in spaced apart relationship with the grip of said handle.

6. The adjustable dumbbell of claim 1, wherein said weight(s) comprise a plurality of inner and outer weights that are provided in a stacked and nested arrangement, each outer weight having end plates longitudinally spaced apart relatively more than the end plates of the next adjacent inner weight.

7. The adjustable dumbbell of claim 1, wherein the end plates of each weight are of the same shape and size.

8. The adjustable dumbbell of claim 1, wherein said means for selectively interconnecting said handle and weight includes a pair of longitudinally spaced apart, lateral pins adapted for engagement with predetermined portions of said handle and said weight(s).

9. The adjustable dumbbell of claim 1, further including:

a pair of relatively smaller, supplemental weights adapted for receipt in openings in the end plates of said weight, between said handle and weight.

10. An adjustable dumbbell, which comprises:

(a) a handle having a longitudinally extending hand grip which the user may grip to hold and manipulate the dumbbell;

(b) a first weight comprising:

(i) a pair of end plates, and (ii) at least one longitudinally extending interconnecting member for joining the end plates together in a longitudinally spaced apart relationship with the interconnecting member of the first weight being separate and distinct from the handle;

(c) connecting means extending substantially perpendicularly to the longitudinal hand grip and interconnecting member and in contacting engagement with both the interconnecting member and some portion of the handle for selectively coupling the handle and first weight together; and (d) wherein the handle includes an opening that extends substantially perpendicularly to the hand grip which opening receives the connecting means therein when the connecting means is inserted into the handle substantially perpendicularly to the hand grip, the connecting means when so received in the opening in the handle abutting against a downwardly facing surface on the interconnecting member of the first weight to lift the first weight upwardly when the handle is lifted upwardly.

11. The adjustable dumbbell of claim 10, wherein the opening in the handle that receives the connecting means is an elongated slot.

12. The adjustable dumbbell of claim 10, wherein the handle has opposed ends which abut against the end plates of the first weight when the handle and the first weight are connected to one another, and wherein the end plates and ends of the handle are angled slightly outwardly when the handle and the first weight are inverted to retain the first weight on the handle.

13. The adjustable dumbbell of claim 10, wherein a plurality of weights having the spaced apart end plate and interconnecting member structure of the first weight are provided with the end plates of different weights being longitudinally spaced apart at progressively greater distances to allow the weights to be nested with respect to one another, and wherein the interconnecting members of the respective weights vertically overlie one another when the weights are so nested with the connecting means being selectively contacted with any one of the interconnecting members to couple a selected number of weights to the handle.

14. The adjustable dumbbell of claim 13, wherein the handle has a plurality of vertically spaced openings corresponding to the number of weights that are provided, wherein the openings are located adjacent the overlying interconnecting members of the weights such that one of the openings receives the connecting means therein regardless of which interconnecting member the connecting means is in contact with.

15. The adjustable dumbbell of claim 10, wherein the connecting means comprises at least one elongated connecting prong.

16. The adjustable dumbbell of claim 15, wherein two connecting prongs are used to couple the handle and the first weight together.

17. The adjustable dumbbell of claim 16, wherein the connecting prongs comprise the opposed sides of a generally U-shaped selector pin.

18. An adjustable dumbbell, which comprises:

(a) a handle;

(b) a plurality of weight plates arranged in two longitudinally spaced apart horizontal stacks with the handle being located between the two weight plate stacks such that opposed ends of the handle abut against innermost weight plates in each stack, and wherein each weight plate in one stack is joined to one weight plate in the other stack by at least one interconnecting member;

(c) connecting means for coupling a selected number of weight plates from each stack thereof to each end of the handle; and (d) wherein the weight plates and ends of the handle are angled slightly outwardly to prevent disconnection of the weight plates from the handle during inversion of the dumbbell even if the connecting means should become disengaged.

19. The adjustable dumbbell of claim 18, wherein the handle ends include outward lips or projections that contact the innermost weight plates during inversion of the dumbbell.

20. An adjustable dumbbell, which comprises:

(a) a plurality of weight plates arranged in at least one stack thereof, wherein the weight plates each have a longitudinally extending member with the longitudinally extending members of the respective weights vertically spaced above and overlying one another when the weights are arranged in the stack;

(b) a handle having a longitudinally extending hand grip which the user can grip to hold and manipulate the dumbbell, wherein the handle has a plurality of vertically spaced openings located adjacent the vertically spaced, longitudinally extending members on the weight plates; and (c) connecting means for coupling a selected number of weight plates from the stack thereof to the handle, wherein the connecting means comprises at least one connecting prong insertable within one of the openings on the handle and when so inserted being in contacting engagement with one of the overlying members on the weight plates to lift upwardly on said one overlying member and on the overlying members above said one overlying member when the handle is lifted to thereby couple a selected number of weight plates to the handle.

21. The adjustable dumbbell of claim 20, wherein the connecting prong extends substantially perpendicularly to the longitudinal hand grip and to the longitudinally extending members on the weight plates when inserted into one of the openings on the handle.

22. An adjustable dumbbell, comprising:

a handle including a grip;

a plurality of weights, wherein each weight includes a pair of end plates and means for interconnecting the end plates together in longitudinally spaced apart relationship with the interconnecting means of each weight being separate and distinct from the handle, wherein the end plates of different weights are longitudinally spaced apart at progressively greater distances to allow the weights to be disposed in a nested and stacked arrangement with respect to one another; and means for selectively interconnecting said handle and a desired number of said weights.

23. An adjustable dumbbell, which comprises:

(a) a handle having opposed ends;

(b) a plurality of weight plates arranged in two longitudinally spaced apart horizontal stacks;

(c) connecting means for coupling a selected number of weight plates from each stack thereof to each end of the handle, wherein the connecting means comprises at least one connecting pin which is shaped to be telescopically inserted into the handle into different positions on the handle to thereby couple different numbers of weight plates from each stack thereof to each end of the handle; and (d) wherein the handle is located between the two weight plate stacks with the opposed ends of the handle lying longitudinally inwardly of the weight plate stacks such that the dumbbell has an overall length which is determined by how many weight plates from each stack are coupled to each end of the handle with the overall length of the dumbbell increasing when more weight plates are coupled to each end of the handle and the overall length of the dumbbell decreasing when fewer weight plates are coupled to each end of the handle.

* * * * *